US006542049B2

(12) United States Patent
Henningsson et al.

(10) Patent No.: US 6,542,049 B2
(45) Date of Patent: Apr. 1, 2003

(54) COMPACT COMBINATION UNIT

(75) Inventors: Uno Henningsson, Haninge (SE); Christer Ahlberg, Kolbäck (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/981,759

(22) Filed: Oct. 19, 2001

(65) Prior Publication Data

US 2002/0093393 A1 Jul. 18, 2002

(30) Foreign Application Priority Data

Oct. 20, 2000 (SE) ..... 0003800

(51) Int. Cl.[7] ..... H01P 5/12
(52) U.S. Cl. ..... 333/132; 333/134; 333/202
(58) Field of Search ..... 333/125, 126, 333/129, 132, 134, 202

(56) References Cited

U.S. PATENT DOCUMENTS 4,728,913 A * 3/1988 Ishikawa et al. ..... 333/202
5,440,281 A 8/1995 Wey et al.
5,739,731 A 4/1998 Hicks et al.
5,831,490 A * 11/1998 Sarkka et al. ..... 333/126
5,894,250 A * 4/1999 Ravaska et al. ..... 333/134
5,986,520 A * 11/1999 Abeno et al. ..... 333/134

FOREIGN PATENT DOCUMENTS

EP 0432729 A2 6/1991

* cited by examiner

*Primary Examiner*—Seungsook Ham

(57) ABSTRACT

The invention relates to a combiner (1) for electromagnetic waves that are to be sent or received in, for example, a radio base station. The combiner comprises a first unit and at least one second unit, where the first unit comprises a first casing (8), at least two component arrangements, each of which comprises a connector (13) connected to the first casing and designed to make a connection with a device for the transmission of electromagnetic waves, at least one insulator (31) connected to the connector and enclosed in the first casing and an input device which is connected to the insulator (31); at least one screen (36) between the insulators, for screening electromagnetic fields; and at least one circuit board (37) with at least one sensor (41, 42) at least partially housed in the first casing; where the second unit comprises a second casing (14) that defines a cavity (33) for electromagnetic waves for each of the input devices, and at least one output device (5) for tapping electromagnetic waves from at least one of the cavities. The invention also relates to a radio base station and the first unit.

18 Claims, 5 Drawing Sheets

COMPACT COMBINATION UNIT

TECHNICAL FIELD OF THE INVENTION

The present invention relates in general to a combiner for electromagnetic waves, for example, in a radio base station. In addition, the invention relates to a unit for a combiner and to a radio base station with one or more such combiners.

DESCRIPTION OF RELATED TECHNOLOGY

In, for example, radio base stations, combiners are used for feeding and filtering of, for example, microwaves of particular frequencies from different transmitters to a shared antenna in order to prevent signals of a particular frequency from one transmitter affecting signals from another transmitter and in order that the signals should reach the antenna without being attenuated too much. A combiner comprises several cavity filters, such as waveguide filters, coaxial filters or ceramic filters, which are each connected to their respective transceiver by a lead. From the cavity filters an output signal is taken out and led to the shared antenna via, for example, coaxial cables belonging to a star connection and a shared bandpass filter.

U.S. Pat. No. 5,440,281 A describes a combiner in a radio communication system for mobile telephony and is hereby incorporated as a reference. Each cavity filter in the device described comprises a tuner, the position of which in relation to a resonator body can be varied for setting a resonance frequency for each cavity filter. This setting is carried out manually, which is not suitable for many applications where there is a need to change the resonance frequency of the cavity filters frequently. Therefore modern cavity filters are provided with a motor that is controlled by an automatic or remote-controlled control unit. In addition, modern combiners comprise sensor units for taking measurement values, such as temperature and current, which measurement values are processed by the control unit. In addition, devices are included for protecting the transceivers from generating harmful intermodulation products and for suppressing the transmission of intermodulation products to the antenna. These devices are designed to pass current/power in one direction but to prevent current in another direction. Examples are circulators and insulators, where losses in one direction are much greater than losses in another direction. Throughout the remainder of this Application, the devices for protecting the transceivers are called "insulators". These insulators can produce a relatively large amount of heat that must be dissipated and they must also be screened carefully in order not to interfere with surrounding electrical and electronic components and signals. The insulators are therefore each housed in separate casings designed to provide sufficient screening and because of a lack of space the insulators are positioned on different sides of the cavity filters, which makes the cooling difficult. Regarding radio base stations, there are standardized dimensions for how much space the combiners can take up. Present configurations mean that a large number of coaxial cables must be used to connect together among other things cavity filter, sensor unit, control unit and insulators. The limited space, together with the many combiners and their associated coaxial cables, means, for example, that inspection, assembly, repairing and cooling of the combiners can be made more difficult.

SUMMARY

A first aim of the present invention is to achieve a combiner that allows more simple assembly, manufacture, repairing and inspection of the combiner.

A second aim is to achieve a combiner that allows better cooling of the components incorporated therein.

A third aim is to improve the performance of a combiner, both mechanically and electrically.

A fourth aim is to reduce the effect of both electrical fields and magnetic fields that the different units generate and with which they affect each other.

A fifth aim is to increase the reliability of a combiner and thereby of a radio base station.

A sixth aim is to increase the number of variants of combiners that can fit in a radio base station of standard dimensions. Additional aims, advantages and effects will be apparent from the following description.

The invention relates to a combiner for electromagnetic waves. The combiner comprises a first unit and a second unit, where the first unit comprises

- a first casing;
- at least two component arrangements, each comprising
  - a connector connected to the first casing and designed to make a connection with a device for the transmission of electromagnetic waves,
  - at least one insulator connected to the connector and enclosed in the first casing and
  - an input device which is connected to the insulator;
- at least one screen between the insulators, for screening electromagnetic fields; and
- at least one first circuit board with at least one sensor, where the first circuit board is at least partially housed in the first casing;

and where the second unit comprises

- a second casing that defines a cavity for electromagnetic waves for each of the input devices, and
- at least one output device for tapping electromagnetic waves from at least one of the cavities.

By this means, a compact combiner is achieved with a single common casing for insulators, input devices and circuit board for taking measurement values. By achieving a smaller combiner for a required frequency, more combiners can be fitted into a radio base station with standardized internal dimensions, as well as more variants of combiners. As the insulators, input devices and the circuit board are assembled in the same casing, a better precision is achieved between the parts compared to if these components had been assembled in different casings. The improved precision makes it easier to calibrate the interaction between these components concerning, for example, a common impedance, and it is easier to obtain the required accuracy in the signals that are to pass through these components. The collecting of the insulators in a single casing also means that a cooling medium only needs to be taken past the first casing for cooling purposes, and not past several casings that are usually located at a distance from each other. In addition, the number of cables is reduced for the combiner, which among other things means that the combiner is cheaper to manufacture and that the power losses in the combiner are smaller.

The first casing suitably comprises a first casing element and a second casing element, where at least the second casing element is provided with at least a first cooling fin and the insulators are in contact with the second casing element. By this means, improved cooling of the first casing and the insulators is achieved.

The input devices are preferably partially enclosed in the first casing and partially enclosed in the second casing. By only the first and the second casing being involved in the fixing of the input devices, the precision of the very important position of the input devices in the cavity is improved, as few components result in smaller tolerances.

In order to be able to connect the input devices to the respective cavity in a simple way, the second casing comprises a third casing element with through-openings to receive the input devices, the number of which openings is the same as the number of input devices.

The third casing element comprises at least one integral external conduit that acts as an outer conductor for the output device for connection to, for example, a star connection, where both the conduit and the output device extend away from the cavities. By this means, the output device can be connected to a star connection in a secure way at a distance from the cavities, which makes the assembly of the combiner even easier.

The combiner preferably comprises a third unit, where the third unit comprises:

a third casing, a second circuit board with a CPU for receiving and processing measurement signals from the first circuit board and for controlling motors, the number of which is the same as the number of cavities, for moving tuners in the cavities, and at least one port designed for a cable to an external computer unit or display screen. By this means, a combiner is achieved that, for example, can process measurement values and automatically or upon command from the external computer unit, control the motors so that they set the required resonance frequency in any of the cavities.

The third casing preferably comprises at least one second cooling fin and the second circuit board comprises at least one memory for data. By this means, improved cooling of the second circuit board and the ability to save measurement values or other information in the memory are achieved.

The combiner preferably comprises at least one connecting circuit board that is connected between the first circuit board and the second circuit board and that thereby enables measurement signals from the first circuit board to be sent to the second circuit board. By this means, an even more reliable combiner is achieved, as cables must otherwise be used.

The first casing and the third casing are suitably fixed to the second casing on the third casing element in such a way that the port, connectors and output device are pointing in the same direction and situated essentially in the same plane. By this means, a common front is obtained for the three units, to which input signal cables, power supply cables, data cables to the CPU and output cables can easily be attached.

In order for the combiner to be suitable for a radio base station for the transmission of microwaves, the combiner comprises resonators, the number of which is the same as the number of cavities.

The output device preferably comprises a coaxial conductor and a loop, which is inserted into two of the cavities to tap off electromagnetic waves.

The output device is suitably designed to be connected to a star connection that leads to a bandpass filter. By this means, for a conventional star connection, at least two output signals from one or more units of the same type as the second unit according to the present invention are sent to a bandpass filter in a common cable.

The present invention also relates to a radio base station that comprises at least one of the combiners described above.

In addition, the present invention relates to a unit for a combiner, comprising a casing;

at least two component arrangements, each of which comprises a connector connected to the casing and designed to make a connection with a device for the transmission of electromagnetic waves, at least one insulator connected to the connector and enclosed in the casing and an input device which is connected to the insulator;

at least one screen between the insulators, for screening electromagnetic fields; and at least one circuit board with at least one sensor, where the circuit board is at least partially housed in the casing.

In order to reduce the manufacture of different parts and thereby reduce the tolerances between the screen and the insulators, the screen is integrated into the second casing element.

The casing suitably comprises guide pins and the circuit board suitably comprises corresponding guide holes or recesses for the guide pins, in order to make it easier to guide the control card during assembly.

The input devices can preferably be inserted into the casing from outside through openings in the casing intended for the input devices, even when the two casing elements are fixed to each other. In addition, the unit comprises conductors, the number of which is the same as the number of connectors, which conductors connect the connectors to the respective insulator.

Each of the conductors is preferably located at least partially in its respective recess in the casing, and sensor devices, the number of which is the same as the number of conductors, for recording the direction of the current/power that passes through the conductors, are comprised in the circuit board and placed on the circuit board in such a way that each recess has at least one of the sensor devices essentially directly above it. By this means, a unit is achieved that can read off the power/current that arises in the respective conductors.

The sensor devices are preferably directional connectors, such as directional couplers. In addition, the unit comprises temperature sensors, preferably arranged on the circuit board, for sending warning signals if the temperature should become too high in the unit.

BRIEF DESCRIPTION OF THE FIGURES

The aims, advantages and effects, and the characteristics of the present invention will be understood more easily as a result of the following detailed description of a preferred embodiment, where the description is to be read in conjunction with the enclosed drawings, in which.

DETAILED DESCRIPTION OF EMBODIMENTS

Figure 1:
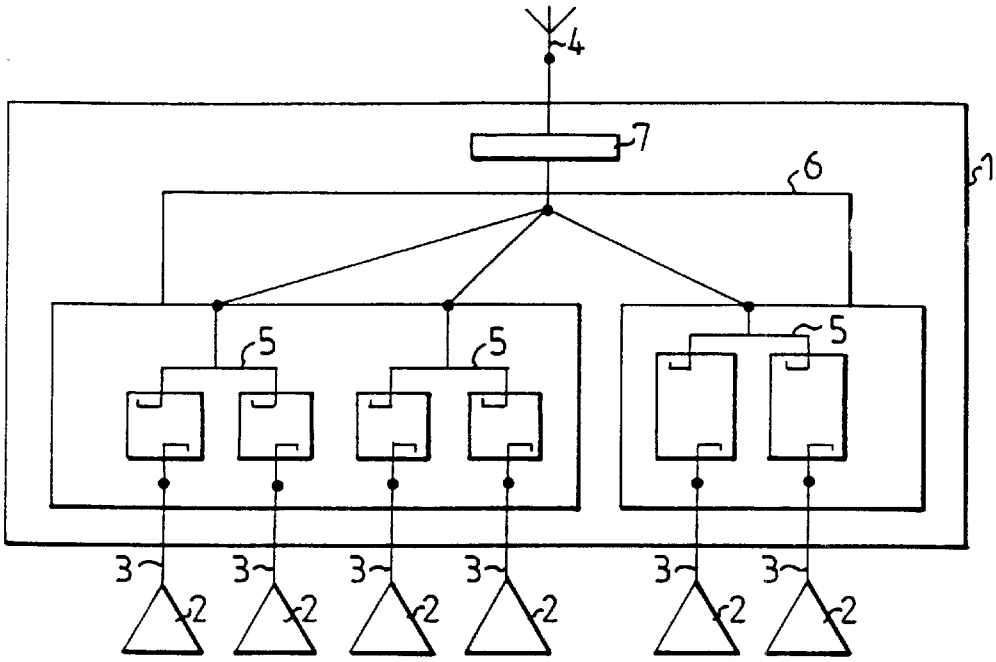
FIG. 1 shows an outline drawing of a radio base station with a combiner according to a preferred embodiment of the invention.

While the invention covers various modifications and alternative designs, a preferred embodiment of the invention is shown in the drawings and will be described in detail below. It should, however, be understood that the special description and the drawings are not intended to limit the invention to the specific form shown. On the contrary, it is intended that the scope of the invention to which the application refers comprises all modifications and alternative designs thereof that fall within the concept and scope of the invention as expressed in the attached claims.

FIG. 1 shows a schematic block diagram for a radio base station with a combiner 1 according to a preferred embodiment. The radio base station comprises transceivers 2 for radio frequency signals that [are connected] via means 3 such as coaxial cables, for transmission of the radio frequency signals to the combiner 1 which in turn is connected to an antenna 4, which is thus common to the transceivers 2. The combiner 1 comprises here six cavity filters for tuning a particular frequency for each signal that is sent from the transceivers 2. Four of the cavity filters are comprised in a common casing while the two other cavity filters are housed in a second casing. Radio frequency signals tapped off from the cavity filters are led through output devices 5, with pairs of cavity filters sharing a common output device 5, to a star connection 6 that connects together the output devices 5. The radio frequency signals from all the output devices 5 are thus led through a single lead to a bandpass filter 7, and thereafter to the antenna 4. The transceivers 2, the star connection 6, the bandpass filter 7 and the antenna 4 do not constitute part of the invention and their function is therefore not described in greater detail.

Figure 2:
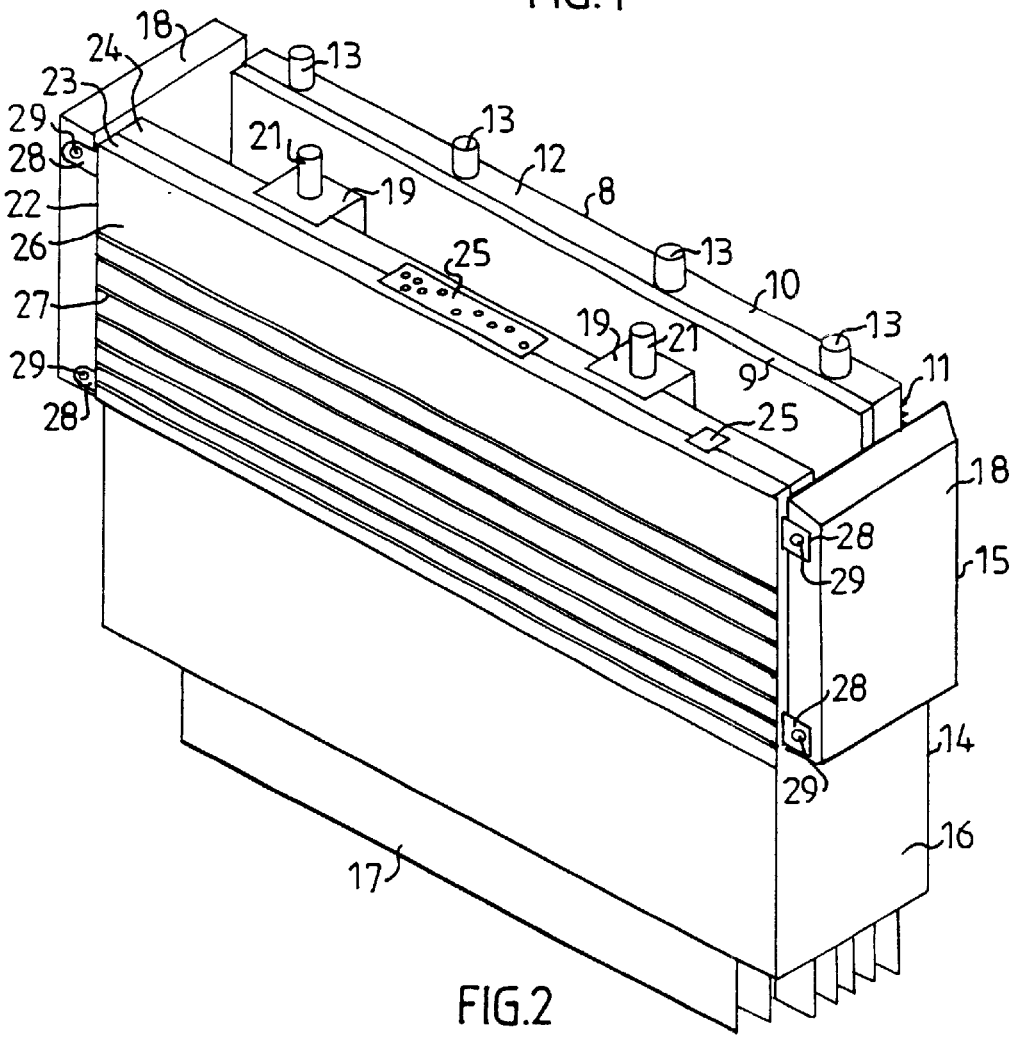
FIG. 2 shows a perspective view of a part of the combiner according to the preferred embodiment comprising a first unit, a second unit and a third unit.

FIG. 2 shows three units of the combiner, where the units are connected to each other to form a common front which makes possible simple connection of a front panel, star connection 6 and cables (not shown here). A first unit comprises an earthed first casing 8, which in turn comprises a first casing element 9 which is constructed in one piece and a second casing element 10 which is also constructed in one piece. Here the second casing element 10 is provided with cooling fins 11 in order to facilitate the dissipation of heat that is created by the components inside the casing, which components are described in greater detail later. Fastened to a front surface 12 of the second casing element 10 are four connectors 13 that have here been designed for connection to coaxial cables (not shown) from the transceivers 2 at the common front. The second unit comprises an earthed second casing 14, that comprises a third casing element 15 in the form of a cover for the cavity filters (see also FIG. 5 for clarification) and a fourth casing element 16 that is provided with integral cooling fins 17 projecting from an external bottom surface. The cover is constructed in one piece and comprises a bottom plate, that is in contact with the fourth casing element 16 and two side flanges 18 that extend up to the common front. The cover also comprises two tower-shaped conduits 19 that also extend up to the common front essentially parallel to the two side flanges 18. The conduits 19 constitute outer conductors for a coaxial structure and are intended to screen and support their respective coaxial inner conductor 20 (see FIG. 7) which runs inside the conduit 19 up to the common front and constitutes a part of one of the output devices 5. The inner conductors 20 in the conduits 19 are connected to a second group of connectors 21 at the front for connection to the star connection 6. A third unit comprises an earthed third casing 22 that comprises a fifth casing element 23 and a sixth casing element 24. Ports 25 for connecting to communication cables and power supply cables are attached to the third casing 22 at the common front. The fifth casing element 23 has an outer side 26 that is provided with integral cooling fins 27 to improve the dissipation of heat from components that are housed in the third casing 22. The fifth casing element 23 comprises in addition lugs 28 with holes, which holes 29 are threaded and correspond to threaded holes in the side flanges 18 of the cover. By means of fixing elements (not shown), such as screws or rivets, that are inserted into the holes 29 in the lugs and the threaded holes in the side flanges 18 of the cover, the second and third casing, 14 and 22 respectively, are fastened together.

Figure 3:
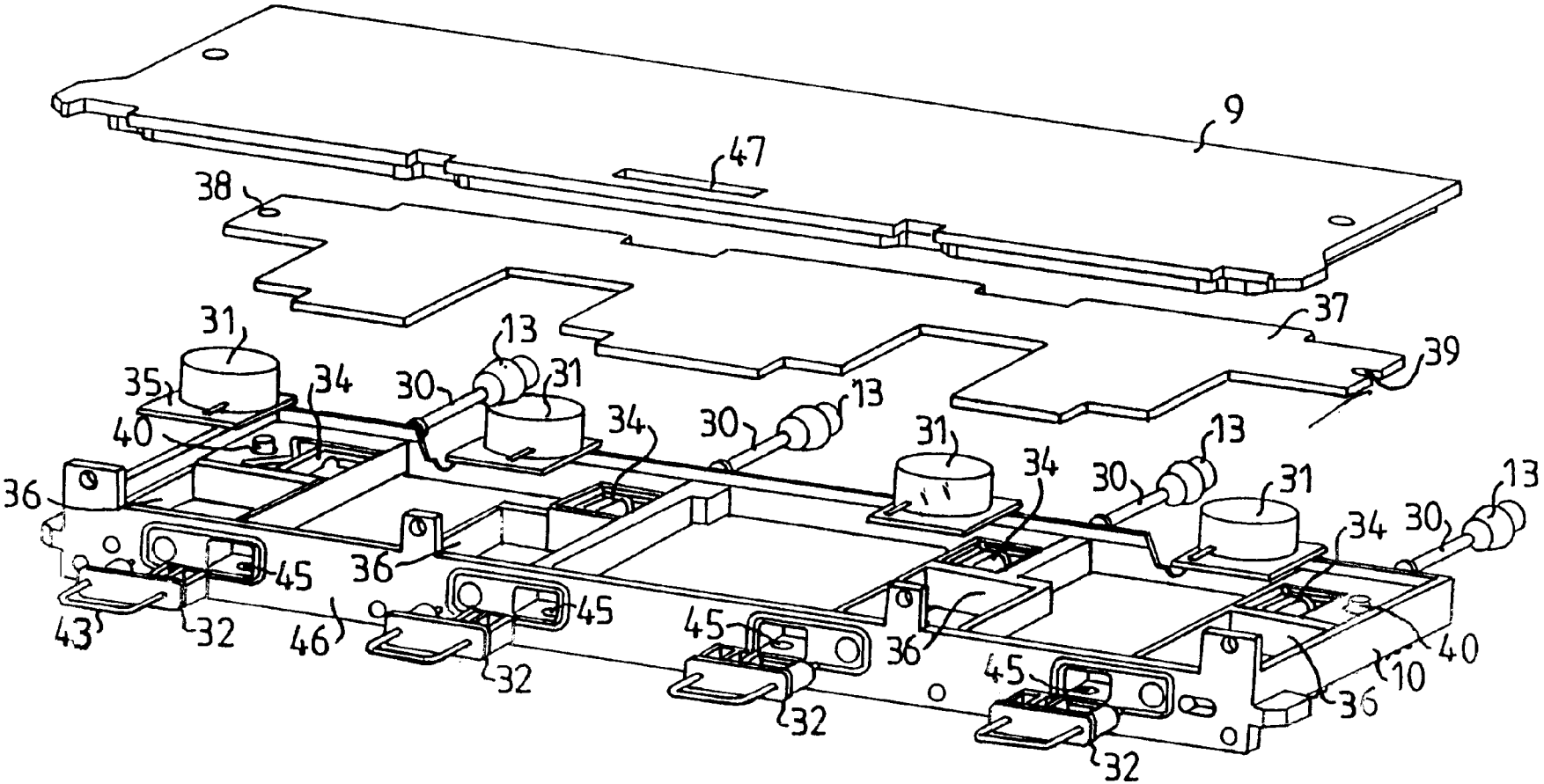
FIG. 3 shows an exploded diagram of the first unit in the first embodiment.
Figure 4:
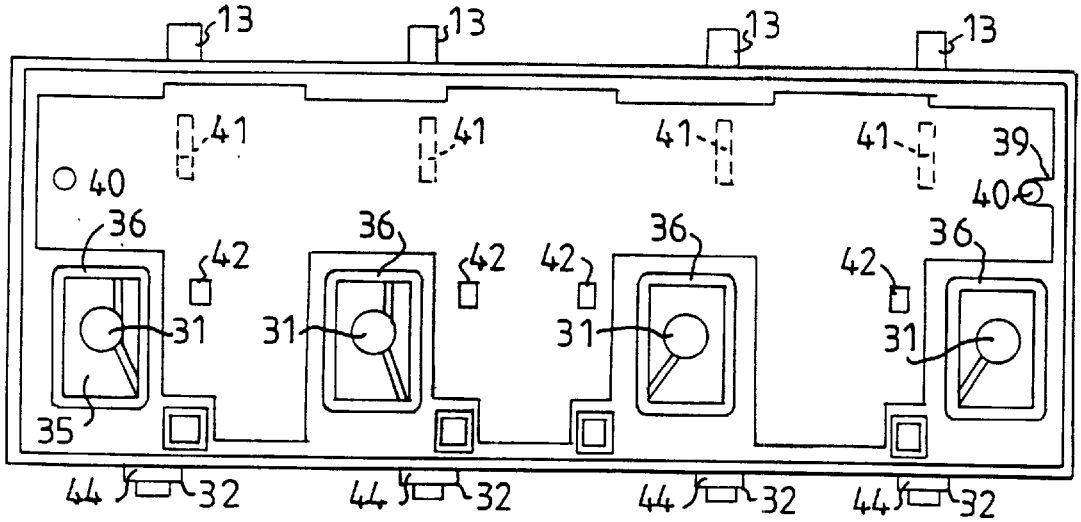
FIG. 4 shows the first unit with a casing element removed.

The first unit will now be described further with reference to FIGS. 3 and 4. Connectors 13 which are designed to make a connection with coaxial cables from the transceivers 2 are installed in holes in the second casing element 10. A first end of four essentially straight conductors 30 is connected to a respective connector 13. The conductors 30 extend into the first casing 8 and a second end of each conductor 30 is connected to its respective insulator 31 which is housed in the first casing 8. The four insulators 31 are also each connected to their respective input device 32 for conducting electromagnetic waves into the respective cavity 33 in the second casing 14 (see FIG. 5). The task of the insulators 31 is to pass current/power only in the direction towards each input device 32. The second casing element 10 is provided with four parallel recesses 34 that are open inwards towards the first casing element 9 and each conductor 30 passes through its respective recess 34, that is so large that the conductor 30 is surrounded by air or other dielectric in each recess 34, that is the conductors 30 are insulated from the first casing 8 as the first casing 8 is connected to earth in a conventional way. The dimensions of the recesses 34 are also such that a required impedance is obtained for the conductors 30 together with the respective insulator 31 and input device 32. The insulators 31 produce heat during the operation of the radio base station that must be dissipated. For this purpose, the insulators 31 comprise a plate 35 with good heat conductivity. The plate 35 is in contact with the second casing element 10 so that heat from the insulators 31 can be conducted to the cooling fins 11 on the second casing element 10 in an effective way. A means for screening off the electromagnetic fields that are created try the insulators 31 in the form of a wall 36 is integrated into the second casing element 10 for each insulator 31. Each wall 36 forms a closed ring around the respective insulator 31. The internal dimensions of the ring are selected in such a way that the walls 36 also serve as guide elements for the assembly of the insulators 31 in the first casing 8. Housed in the first casing 8 is also a first circuit board 37, that has a guide hole 38 and a recess 39 for receiving guide pins 40, which are integrated into the second casing element 10. Alternatively, the guide pins can be surface-mounted on the first circuit board, which surface-mounted guide pins are inserted in guide holes in the first or second casing element, 9 and 10 respectively, in order to save processing costs when manufacturing the first and the second casing elements, 9, 10. In order to avoid the insulators 31 interfering with circuits and components on the first circuit board 37, to reduce direct heating up of the first circuit board 37, and to allow the insulators 31 to be replaced without removing the first circuit board 37, the first circuit board 37 is a shape that means that it does not cover the insulators 31, but instead has an outer contour that partially follows the screening walls 36. However, the first circuit board 37 covers the four recesses 34 for the conductors 30 in such a way that four current sensors 41 in the form of directional connectors, such as directional couplers, that are surface mounted on the first circuit board 37, are placed in such a way that the directional connectors are each located in their respective recess 34 at a particular distance from the conductors 30 running in the respective recess 34. When current/power is passed through one of the conductors 30, a magnetic field is generated around the conductor 30 and variations in this magnetic field create through inductance a current in the corresponding directional connector, which then detects by a measurement of the size and direction of the current/power in the conductor 30 if the current is going in a particular direction. The first circuit board 37 also comprises surface-mounted temperature sensors 42 that detect the temperature of the first casing 8. The input devices 32 comprise an electrically conductive loop 43 and a dielectric part 44. The input devices 32 are partially housed in and attached to the first casing 8 by being partially inserted through a first group of openings 45 in a back surface 46 of the second casing element 10 during assembly, so that only a part of each input device 32 protrudes from the back surface 46 in a direction away from the front surface 12. The design of the input devices 32 does not need to be described in greater detail, as their detailed design is not associated with the present invention. The first casing element 9 comprises a first elongated through-hole 47 for taking a connecting circuit board 48 that is intended to be connected to circuits in the first circuit board 37. This is discussed in greater detail later in connection with FIG. 9.

Figure 5:
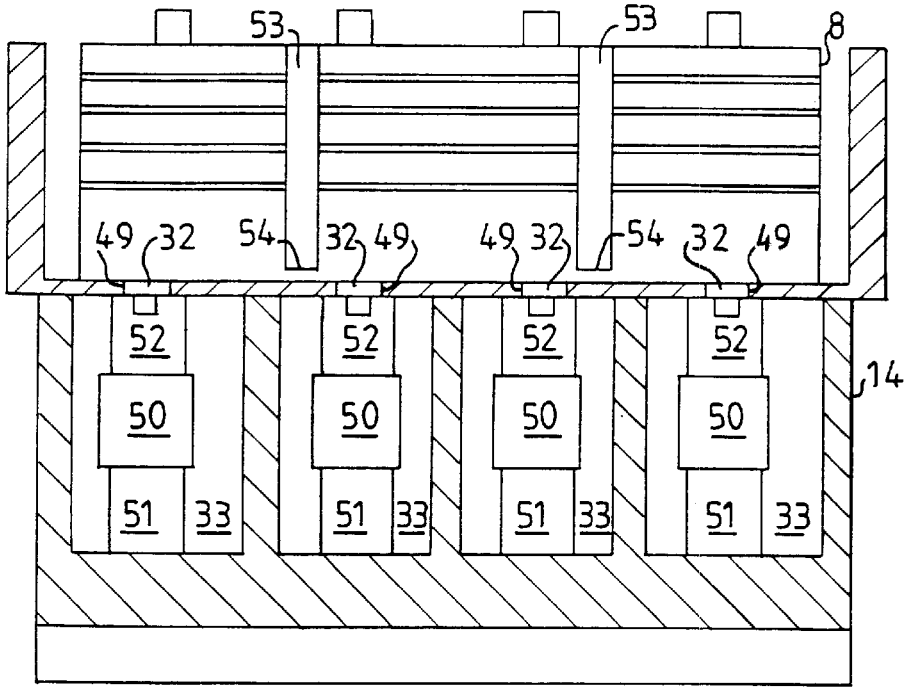
FIG. 5 shows a partially sectional view of the second unit and the first unit.

As the first unit is mounted on the second unit, the part of the input devices 32 that is outside the first casing 8 is inserted into the second casing 14 through an opening 49 for receiving the input devices in the cover for each input device 32, where the openings 49 for receiving the input devices each lead into a respective cavity 33. This is shown in FIG. 5, where the first casing 8 is not shown in cross section, while the second casing 14 is sectioned longitudinally at the openings 49 for receiving the input devices. FIG. 5 also shows that the second casing 14 comprises the four cavities 33 with one dielectric resonator 50 each, where each resonator 50 is fixed in its cavity 33 by means of a lower and an upper dielectric support, 51 and 52 respectively. This also shows two essentially straight channels 53 that are formed on the side of the second casing element 10 that is provided with cooling fins. The channels 53 have a first end at the front 12 of the second casing element 10 and extend towards the back 46 of the second casing element 10. A second end of each of the channels 53 terminates at a respective step 54 before the back 46 of the second casing element 10 is reached.

Figure 6:
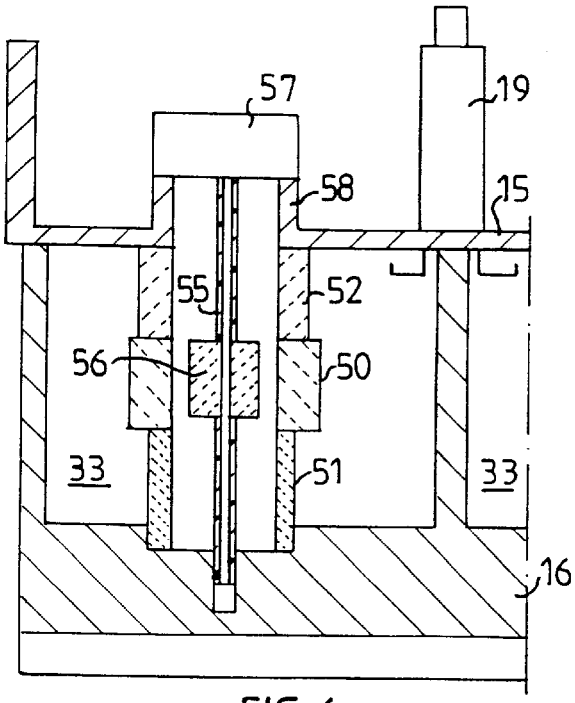
FIG. 6 shows a second cross-section of the second unit.

FIG. 6 shows in simplified form a part of a second longitudinal section of the second unit. It is to be understood that the three cavities 33 that are not shown in this section comprise essentially identical elements to the cavities 33 shown. The section is parallel to that in FIG. 5, but situated further in towards the centre of the cavities 33 and located in such a way that the section goes through the centre of the resonator 50 and the two supports 51, 52. Both the resonator 50 and the two supports 51, 52 have a concentric hole in order to allow a dielectric spindle 55 with a dielectric tuner 56 to be placed inside the hole in the supports and the resonator. The dielectric spindle 55 is mounted on a shaft of a motor 57, such as an electric stepping motor or linear motor. Using the motor 57, the tuner 56 can be moved linearly in and out in the hole in the resonator 50 in order to change the resonance frequency of the cavity filter. Neither the detailed attachment of the respective resonators 50, supports 51, 52 and spindles 55 to the motor 57 and the second casing 14, nor the detailed design of the respective resonators 50, supports 51, 52 and spindles 55 constitute a part of this invention and they are therefore not described further. Each of the four motors 57, which belong to the four cavity filters that are housed in the second casing 14, is attached to the cover at one end of its respective conduit part 58 integrated into the cover and extending in a direction towards the common front.

Figure 7:
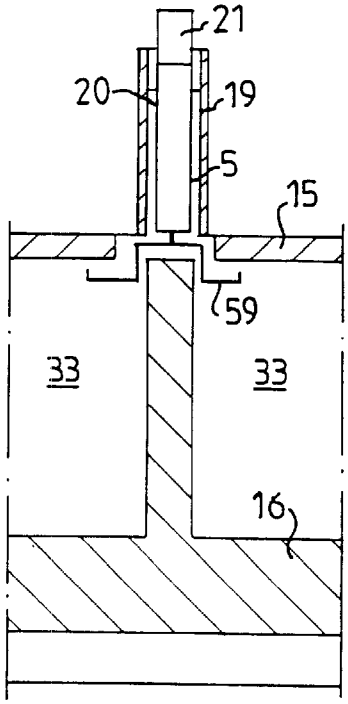
FIG. 7 shows a third cross-section of the second unit.

FIG. 7 shows a third section that is parallel to the sections in FIGS. 5 and 6. The section is created in such a way that one of the conduits 19 can be shown in section in order to provide a better understanding of one of the two output devices 5. The output device 5 shown comprises a loop 59 that is inserted into two of the cavities 33 for tapping off electromagnetic waves from each cavity. From the two cavities, the loop 59 is taken through a partition between the two cavities shown that is integrated into the cover. In order not to come into contact with the partition, the loop 59 is surrounded by a dielectric in the form of air when passing through the partition. Alternatively, the loop 59 can be embedded in an insulating plastic casing. Outside the cavities 33, the loop 59 is connected by a connector to the inner conductor 20 in the output device 5 that is mounted inside the conduit 19 shown, at the end of the conduit at the common front of the units. In this way, two cavities 33 share a common outlet device 5, which saves space and material.

Figure 8:
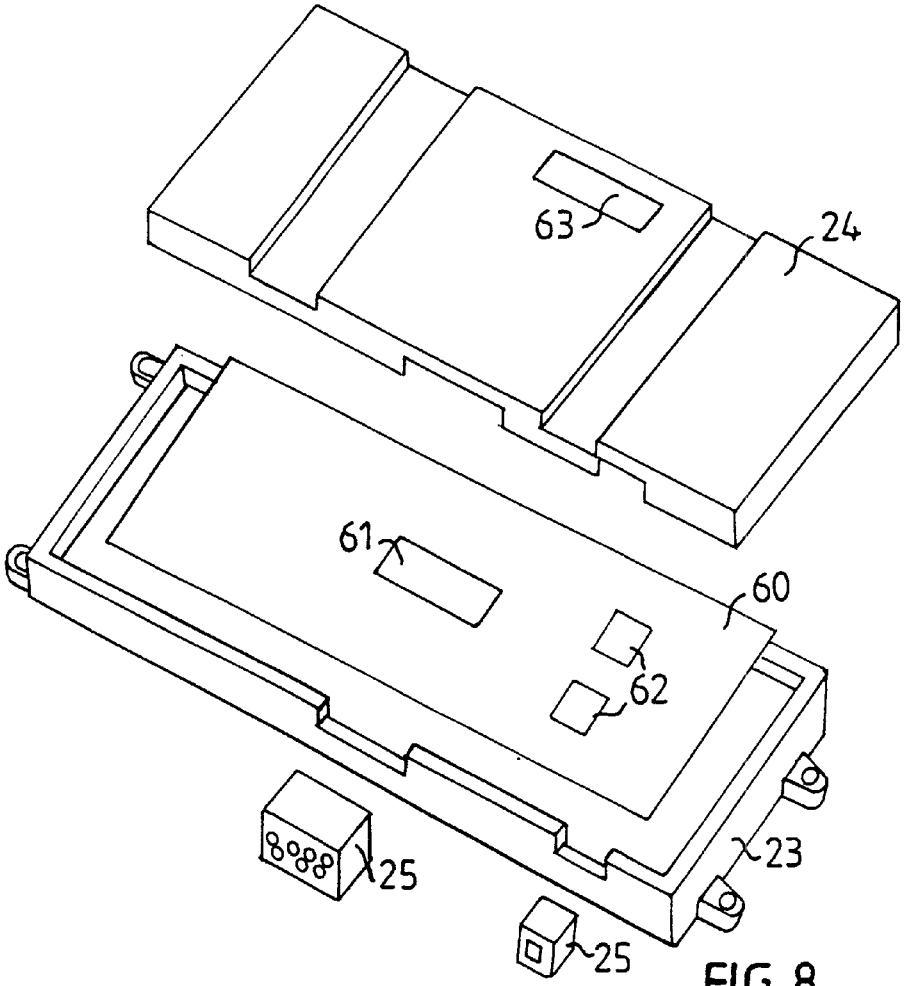
FIG. 8 shows an exploded diagram of the third unit.

FIG. 8 shows a schematic exploded diagram of the third casing where the fifth casing element 23 is the lowest of the casing elements and the sixth casing element 24, which when assembled is turned towards the first casing 8, is the upper element. A second circuit board 60 is housed in the third casing 22 when assembled, in such a way that the second circuit board 60 is in contact with the fifth casing element 23 for good conduction of unwanted heat away from the second circuit board 60 to the cooling fins 27 on the fifth casing element 23. A CPU 61 in the form of an integrated chip is mounted on the second circuit board and constitutes, among other things, a control unit for the four motors. Memory 62 in the form of a chip is also comprised in the second circuit board 60 and connected to the CPU 61. The seventh casing element 24 is provided with a second elongated through-hole 63 to take the connecting circuit board 48, which in addition to being connected to the first circuit board 37 is designed to be connected to the second circuit board 60.

Figure 9:
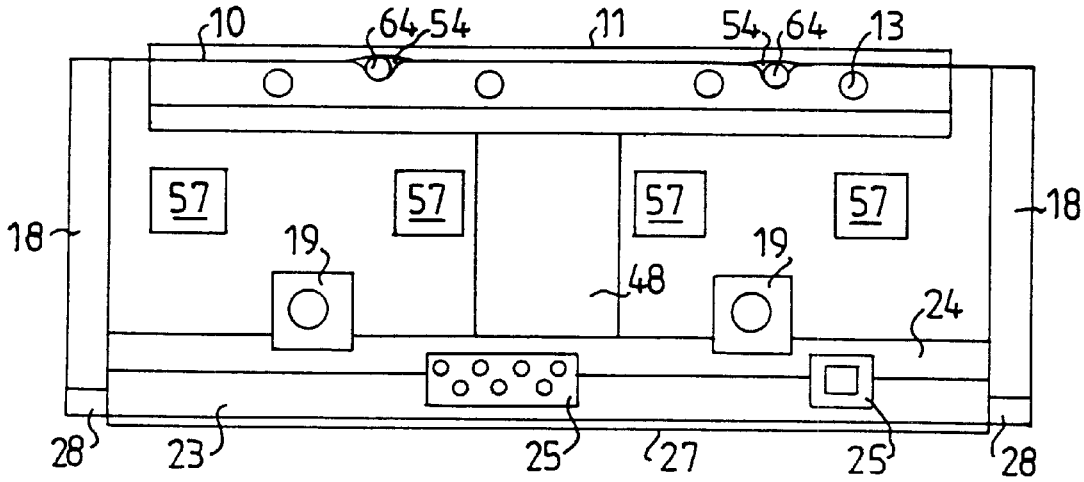
FIG. 9 shows the combiner from directly above.

The unit that is shown in FIG. 2 is seen from above in FIG. 9. Fixing elements in the form of screws 64 are screwed into threaded through-holes in the second casing element 10 and corresponding bottom holes (not shown) in the cover, in order to fix the first casing directly to the second casing. When fully screwed home, the screws make contact with the steps 54, and the screwing home is carried out by, for example, inserting a screw driver down towards the respective step 54 in the respective channel 53. In this figure, a part of the connecting circuit board 48 is also shown, which is inserted in the first and third casing, 8 and 22 respectively, in order to connect together the first circuit board 37 and the second circuit board 60. By means of the connection, for example the directional couplers and the temperature sensors 42 on the first circuit board 37 can send measurement signals to the CPU 61 which then processes the information, forwards the information to some external computer device or screen device, or sends orders concerning shutting down the radio base station, for example because the antenna is out of order. The control method of the CPU 61 does not constitute a part of this invention and is therefore not described in greater detail.

Figure 10:
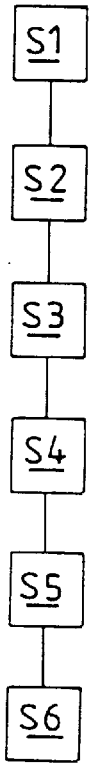
FIG. 10 shows a flow chart for an assembly method.

After having described a preferred embodiment of a part of a combiner 1, the assembly of the three units will now be described with reference to FIG. 10. Step S1 comprises assembling the cavity filters in the second casing 14. This step comprises in order: fixing each resonator 50 in the cavities 33 by means of the two supports, 51 and 52, fixing the cover on the fourth casing element 16, assembling the four spindles 55 with tuners 56 on the respective associated motor 57, inserting the spindles 55 into the respective cavity 33 and attaching the motors 47 [sic] onto the conduit parts 58 integrated into the cover. In step S2, the first unit is assembled. Step S2 comprises attaching the four connectors 13, the four conductors 30, the first circuit board 37, the four insulators 31 and the four input devices 32 in the first casing 8. The first circuit board 37 and the insulators 31 must be installed before the first casing element 9 and the second casing element 10 are fixed to each other with the fixing elements. The input devices 32 are preferably installed after the first and second casing elements, 9, 10, have been fixed to each other. In step S3, the connecting circuit board 48 is connected to the first circuit board 37 by being inserted in the elongated hole 47 in the first casing element 9 so that connecting conductors come in contact with measurement receiver circuits on the first circuit board 37, which measurement receiver circuits are connected, for example, to the directional connectors and the temperature sensors 42. In step S4, the first unit is fixed to the second unit by the part of the input devices 32 projecting from the first casing 8 being inserted into the openings 49 for receiving input devices in the cover and by the first unit being screwed down to the cover from above. The screwing together can be carried out using a screwdriver with a long shank that can reach to screw the screws into holes in the steps 54 guided by the two channels 53. In step S5, the third unit is assembled and in step 6 the third unit is screwed onto the second unit using the lugs 28 with holes on the fifth casing element 23 and corresponding holes in the side flanges 18 of the cover. In order for the connecting circuit board 48 to be able to be connected to the second circuit board 60, when being assembled the third unit is inserted essentially at right angles to the direction of attachment of the first unit, that is if the first unit is installed directly from above the cover, the third unit is installed from the side, so that the third casing "overshoots" the connecting circuit board 48. Now the three units are connected together, in such a way that a front panel (not shown) can be attached on the common front of the three units. All the connecting cables and the star connection 6 can thus be attached easily to the common front.

It should be understood that the communication between the first circuit board 37 and the second circuit board 60 can be implemented via cables instead of the connecting circuit board 48, even though this is less advantageous. Several connecting circuit boards can, of course, also be used.

In addition, it should be understood that instead of a single first circuit board 37 in the first casing 8 and the third casing 22, these casings can comprise several circuit boards.

Even though it is not shown in any of the figures, it should be understood that the CPU 61 can be incorporated in the first casing 8, if there is room for it.

In addition, there does not need to be only one insulator that is connected in series with the connector 13 and the input device 32, but the casing 8 can comprise more than one insulator for each connector.

Instead of fixing the casing elements and the units to each other using fixing elements, it is to be understood that other fixing methods can also be used, such as welding, soldering or gluing.

The number of channels 53 and steps 54 can, of course be varied for the required fixing of the first unit to the second unit. In addition, the first casing element 9 can comprise projecting lugs 28 with holes in order to fix the first unit to the second unit more securely.

What is claimed is:

1. A combiner for electromagnetic waves, comprising:

a first unit, comprising:

a first casing that includes a first casing element and a second casing element, the second casing element having a cooling fin;

at least two component arrangements, each comprising;

a connector connected to the first casing and designed to make a connection with a device for the transmission of electromagnetic waves;

at least one insulator connected to the connector and enclosed in the first casing in contact with the second casing element; and an input device which is connected to the insulator;

at least one screening wall between the insulators for screening electromagnetic fields; and at least one first circuit board with at least one current sensor, wherein the first circuit board is at least partially housed in the first casing;

a second unit, comprising:

a second casing that defines a cavity for electromagnetic waves for each of the input devices; and at least one output device for tapping electromagnetic waves from at least one of the cavities.

2. A combiner according to claim 1, wherein the input devices are partially enclosed in the first casing and partially enclosed in the second casing.

3. A combiner according to claim 2, wherein the second casing comprising a third casing element with through-openings, the number of which is the same as the number of input devices for receiving the input devices.

4. A combiner according to claim 3, wherein the third casing element comprising at least one integral external conduit that acts as an outer conductor for the output device, wherein both the conduit and the output device extend away from the cavities.

5. A combiner according to claim 4, further comprising a third unit, wherein the third unit comprising:

a third casing;

a second circuit board with a CPU for receiving and processing measurement signals from the first circuit board and the controlling motors, the number of which is the same as the number of cavities for moving tuners in the cavities; and at least one port designed for a cable to an external computer unit or display screen.

6. A combiner according to claim 5, wherein the third casing comprising at least one second cooling fin and the second circuit board comprising at least one memory for data.

7. A combiner according to claim 5, further comprising at least one connecting circuit board that is connected between the first circuit board and the second circuit board and that thereby enables measurement signals from the first circuit board to be sent to the second circuit board.

8. A combiner according to claim 5, wherein the first casing and the third casing are fixed to the second casing on the third casing element in such a way that the port, the connector and the output device are pointing in the same direction and situated essentially in the same plane.

9. A combiner according to claim 1, further comprising resonators, the number of which is the same as the number of cavities.

10. A combiner according to claim 1, wherein the output device comprising a coaxial conductor and a loop that is inserted into two of the cavities for tapping off electromagnetic waves.

11. A combiner according to claim 1, wherein the output device is designed to be connected to a star connection that leads to a bandpass filter.

12. A radio base station, comprising:

at least one combiner for combining electromagnetic waves, comprising:

a first unit, comprising:

a first casing that includes a first casing element and a second casing element, the second casing element having a cooling fin;

at least two component arrangements, each comprising:

a connector connected to the first casing and designed to make a connection with a device for the transmission of electromagnetic waves;

at least one insulator connected to the connector and enclosed in the first casing in contact with the second casing element; and an input device which is connected to the insulator;

at least one screening wall between the insulators for screening electromagnetic fields; and at least one first circuit board with at least one current sensor, wherein the first circuit board is at least partially housed in the first casing;

a second unit, comprising:

a second casing that defines a cavity for electromagnetic waves for each of the input devices; and at least one output device for tapping electromagnetic waves from at least one of the cavities.

13. A unit for a combiner, comprising:

a casing that includes a first casing element and a second casing element, the second casing element having a cooling fin;

at least two component arrangements, each of which comprising:

an input device for inputting electromagnetic waves into the combiner;

a connector connected to the casing for making a connection to a device that transmits electromagnetic waves;

an insulator that passes current/power only toward the input device; and a conductor that connects the connector to the insulator;

at least one screening wall between the insulators for screening electromagnetic fields; and at least one circuit board with at least one current sensor for recording the direction of current/power that passes through the conductor, wherein the circuit board is at least partially housed in the casing.

14. A unit according to claim 13, wherein the screening wall is integrated into the second casing element.

15. A unit according to claim 13, wherein the casing comprising guide pins and the circuit board comprising corresponding guide holes or recesses for the guide pins.

16. A unit according to claim 13, wherein the input devices can be inserted into the casing from outside through openings in the casing designed for the input devices, even when the first casing element and the second casing element are fixed together.

17. A unit according to claim 13, wherein the at least one current sensor is a directional connector, wherein the directional connector is a directional coupler.

18. A unit according to claim 13, further comprising temperature sensors arranged on the circuit board.

* * * * *